US006162023A

United States Patent [19]

Newman

[11] Patent Number: 6,162,023

[45] Date of Patent: Dec. 19, 2000

[54] RECIPROCATING CAM ACTUATION MECHANISM FOR A PUMP

[76] Inventor: Graeme Harold Newman, P.O. Box 13485, Auckland, New Zealand

[21] Appl. No.: 09/180,712

[22] PCT Filed: May 12, 1997

[86] PCT No.: PCT/NZ97/00058

§ 371 Date: Nov. 13, 1998

§ 102(e) Date: Nov. 13, 1998

[87] PCT Pub. No.: WO97/43545

PCT Pub. Date: Nov. 20, 1997

[30] Foreign Application Priority Data

May 15, 1996 [NZ] New Zealand ..... 286595

[51] Int. Cl.[7] ..... F04B 41/06; F04B 49/12

[52] U.S. Cl. ..... 417/216; 417/218; 417/429

[58] Field of Search ..... 417/216, 218, 417/286, 374, 222.1, 398, 399, 415, 416, 419, 426, 429; 92/13.1, 13.3, 13.7; 74/101, 102, 103, 104, 108

[56] References Cited

U.S. PATENT DOCUMENTS

| | | | |
|---|---|---|---|
| 1,813,078 | 7/1931 | Nyrop | 417/218 |
| 2,416,171 | 2/1947 | Gray | 417/218 |
| 2,752,989 | 7/1956 | Jenkins, Jr. | 158/36.4 |
| 2,925,780 | 2/1960 | Tear | 103/11 |
| 3,106,895 | 10/1963 | Hood | 417/374 |
| 3,125,961 | 3/1964 | Hrdina | 417/374 |
| 3,612,732 | 10/1971 | Stephens | 417/426 |
| 3,619,090 | 11/1971 | Hartkopf | 417/426 |
| 3,913,458 | 10/1975 | Foures | 92/13.7 |
| 4,080,874 | 3/1978 | Burkhard | 92/13.7 |
| 4,189,070 | 2/1980 | Macosko et al. | 222/134 |
| 4,212,416 | 7/1980 | Bennett | 222/267 |
| 4,264,281 | 4/1981 | Hammelmann | 417/218 |
| 4,273,261 | 6/1981 | Krueger | 417/429 |
| 4,830,589 | 5/1989 | Pareja | 417/216 |
| 4,989,469 | 2/1991 | Eslinger | 74/25 |
| 5,707,212 | 1/1998 | Matthews | 417/415 |

FOREIGN PATENT DOCUMENTS

| | | |
|---|---|---|
| 0311282 | 4/1989 | European Pat. Off. . |
| 0434331 | 6/1991 | European Pat. Off. . |
| 0456387 | 11/1991 | European Pat. Off. . |
| 324027 | 9/1920 | Germany . |

*Primary Examiner*—Willis R. Wolfe
*Attorney, Agent, or Firm*—Jacobson, Price, Holman & Stern, PLLC

[57] ABSTRACT

A multi-pump controlling means and method controls and drives two or more reciprocating pumps creating proportioned flows of fluids. The multi-pump controlling means in use is situated between a driving means, such as a double acting ram, and the pumps. The multi-pump controlling means includes two or more cams that each interact with a cam follower attached to the pumps. The cams may be set or adjusted to different gradients, meaning the cam followers following those gradients when the multi-pump controlling means is reciprocated by the driving means, will have different path lengths. The path lengths of the cam followers control the stroke lengths of the respective pumps and thus the volume of fluid pumped by each of the respective pumps.

25 Claims, 3 Drawing Sheets

RECIPROCATING CAM ACTUATION MECHANISM FOR A PUMP

TECHNICAL FIELD

This invention relates to improvements in pumping. The present invention is used to provide a pump driving and controlling system that can be used to create flows of multiple fluids at high or low pressures.

BACKGROUND ART

No apparatus performing the function of the present invention is known.

DISCLOSURE OF INVENTION

The present invention consists of a multi-pump controlling means comprising:

- a cam system including two or more cams, said cam system being driven by a driving means adapted to reciprocate said cam system in a first plane;
- two or more pumps each including a pump body and a piston adapted to mutually reciprocate in a second plane not lying in or parallel to said first plane;
- cam followers each corresponding to a cam and to a pump, said cam followers being fixed to reciprocate with the reciprocation of the associated piston or pump body, said cam followers also being adapted to follow the path determined by said cam follower's respective cam upon reciprocation of the cam system;
- wherein, in use, the multi-pump controlling means may be adapted so that the reciprocating motion of the cam system drives the pump by causing relative movement between each cam and its respective cam follower and thus causing relative movement between the said cam follower and its respective associated piston or pump body, and their corresponding pump body or piston.

BRIEF DESCRIPTION OF DRAWINGS

One preferred form of the invention will now be described with reference to the accompanying drawings in which.

MODES FOR CARRYING OUT THE INVENTION

Figure 3:
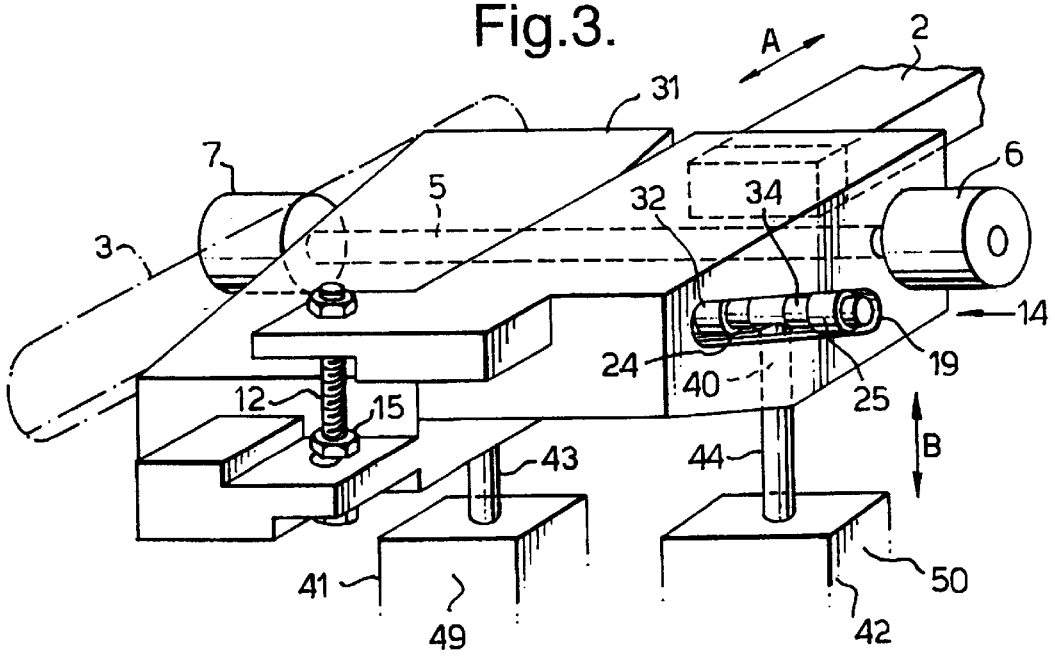
FIG. 3 shows a schematic perspective view of the dual-pump controlling means with the supporting structure cut away for clarity but the position of part of the guide means being shown by dashed lines.

In the preferred form of the invention as shown in FIG. 3, pumps (41, 42) are driven by a driving means (not shown apart from part of the rigid driving rod (2) via cams (30, 31).

Figure 1:
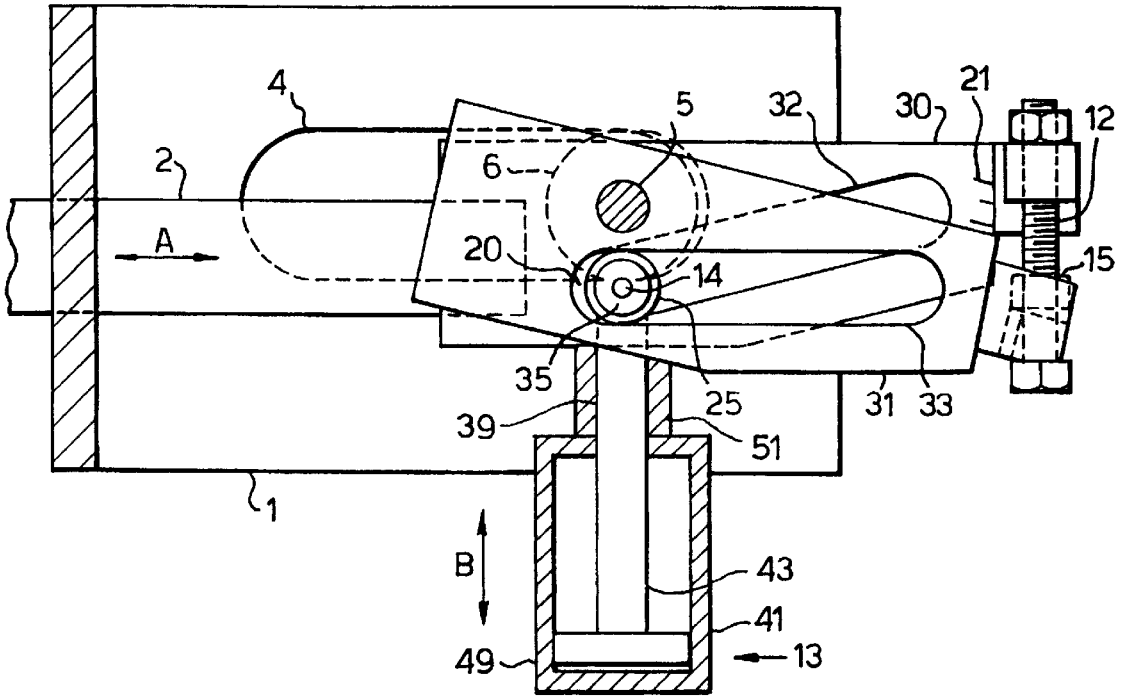
FIG. 1 shows a schematic side elevation of the dual-pump controlling means with parts of the supporting structure cut away for clarity.
Figure 2:
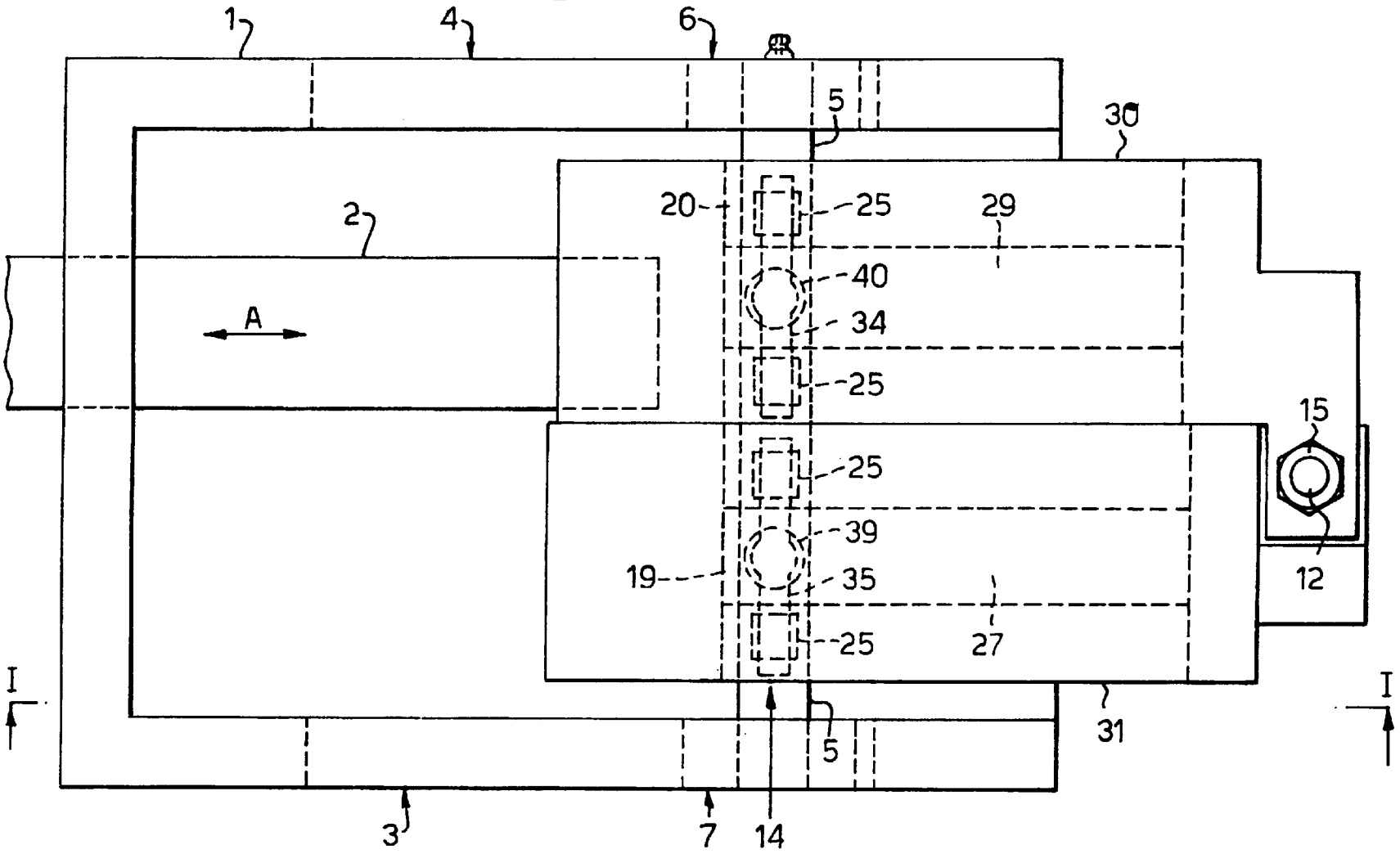
FIG. 2 shows a schematic plan view of a preferred form of a dual-pump controlling means.

FIGS. 1, 2 and 3 show a dual-pump controlling system involving the use of cams (30, 31). One of the cams (31) may be adjusted to various gradients. When the cams (30, 31) are reciprocated by the driving means, in a first plane (in a direction marked by arrow A) substantially normal to a second plane (in a direction marked by arrow B) in which pump pistons (43, 44) are adapted to reciprocate, the cams (30, 31), by interaction with cam followers (34, 35), elevate and depress the pistons (43, 44). The gradients of the cams (30, 31) regulate the extent to which the pistons (43, 44) are elevated and thus the stroke lengths of the pumps (41, 42). By setting the adjustable cam (31) to different gradients the stroke length and thus the intake volume of the associated pump (41) can be altered. Use of the appropriate ratios of stroke lengths allows control of the volumetric intake ratio of the pumps (41, 42) and thus the subsequent volumetric output ratio.

The preferred form of the invention shown in FIGS. 1, 2 and 3 is a dual-pump controlling means with two pumps (41, 42), two cam followers (34, 35), and a cam system including two cams (30, 31).

Other forms of the invention may include more than two pumps and a corresponding number of cams and cam followers.

In the preferred form the pumps (41, 42) are aligned in a direction normal to the direction indicated by arrow A. In other forms the pumps may not be so aligned.

The driving means is adapted to reciprocate the cam system in a first direction indicated by arrow A lying in a first plane, substantially normal to a second plane in which the pistons (43, 44) are adapted to reciprocate (in a direction indicated by arrow B) in relation to the pump bodies (49, 50) fixed to a supporting structure (1).

Other forms of the invention could have the reciprocation planes at angles other than ninety degrees provided the planes were not parallel. Furthermore, in other forms it may be the pump bodies rather than the pistons that are connected to the cam followers with the pistons fixed to the supporting structure though this form is likely to be more cumbersome.

In the preferred form shown in FIGS. 1, 2 and 3 reference to the cam followers (34, 35) indicates the cross-bar connected to the top of the piston shafts (39, 40).

Figure 4:
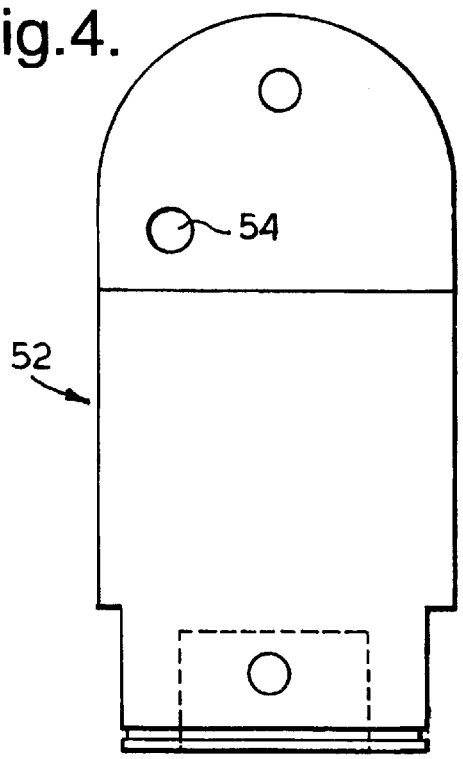
FIG. 4 shows a preferred form of a connecting arm in side view.
Figure 5:
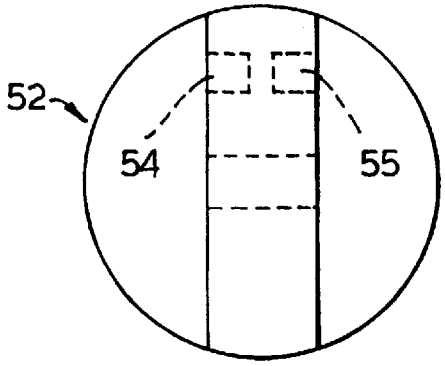
FIG. 5 shows the same preferred form of a connecting arm in plan view.
Figure 6:
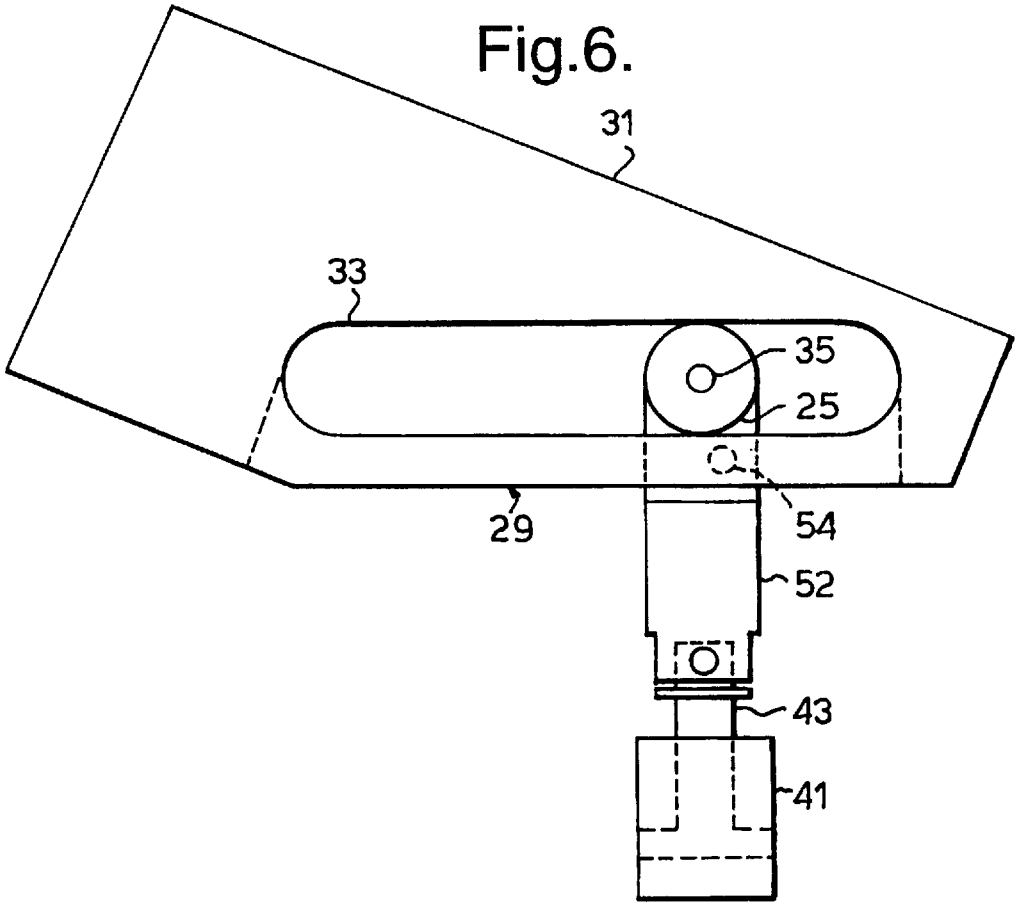
FIG. 6 shows the preferred form of a connecting arm as it interacts with the cam system and pumps.

It is preferable that the invention can be operated utilising prefabricated pumps and without requiring any significant modification to the pumps. Therefore, to attach the pistons (or the pump bodies) to the cam followers without extending or modifying the pistons (or pump bodies) it may be advantageous to use connecting arms (52) as shown in FIGS. 4, 5 and 6. One preferred form of a connecting arm is shown in FIGS. 4 (side elevation), 5 (plan) and 6. FIG. 6 shows the preferred positioning of the connecting arm (52) in relation to the corresponding cam follower (34) and pump (42). Cavities (54, 55) in the connecting arm serve as recipients of portions of teflon or like material that protrude from the cavities and bear against either side of the second slots (27, 29).

FIGS. 1, 2 and 3 show a preferred form of the invention where the pistons extend to the cam followers.

When the cams (30, 31) are reciprocating the cam followers (34, 35) follow paths determined by the cams (30, 31) and thus elevate and depress the associated pistons (43, 44). When the gradient of one of the cams is steeper than that of the other cam the extents of elevation of the pistons and thus the stroke lengths of the pumps will be different. The stroke lengths of the pumps (41, 42) determine the volumetric intake and subsequent output of the pumps.

In FIGS. 1, 2, 3 and 6 the cam followers (34, 35) track along first slots (32, 33) in the cams (30, 31). When the cams (30, 31) are reciprocating thus causing relative movement between the cams (30, 31) and the cam followers (34, 35) it is the first slots that the cam followers (34, 35) occupy. There are second slots (27, 29) substantially normal to and intersecting with the first slot so that in cross-section the slots form a "T" type formation. These second slots (27, 29) are occupied by the shafts of the pistons or the connecting arms if connecting arms are utilised or an extension of the pump body if the pump bodies are connected to the cam followers. In the preferred form as shown in FIGS. 1, 2 and 3 the shafts of the pistons (43, 44) pass through the second slots in the cams (30, 31) and are fixed to the cam followers (34, 35) at the intersection of the uprights (second slots) and cross-bars (first slots) of the "T" formation of slots. In the preferred form shown in FIG. 6 it is part of the connecting arm that passes through the second slot and is connected to the cam follower. The cam followers (34, 35) extend across the first slots on either side of the second slots (29) and cam race bearings (25) are used to facilitate the relative movement between cams (30, 31) and cam followers (34, 35). The first slots (32, 33) may be crowned or flat or of other practical design. The bearings may be crowned or flat or of other practical design. It has been found that by using crowned bearings the consistency of the movement of the cam followers is greater.

Other forms of cam followers and techniques of path tracing may be used in place of the illustrated example. For example instead of slots, the cams may include a bar or pole or rail upon which cam followers in the form of rings or hooks or trolleys may bear, or the cam followers may extend in only one direction from their point of intersection with the piston shaft or connecting arm.

For the preferred form of the invention to be efficient it is necessary to ensure that any relative movement between the moving parts (the reciprocating cam system and reciprocating pistons (43, 44)) and the non-moving parts of the driving means and the pumps is kept substantially consistent. There are a number of features in the preferred form that serve this end.

Firstly, the pump bodies (49, 50) and the driving means are fixed to a supporting structure (1) or structures. In FIGS. 1, 2 and 3 all or part of the supporting structure is not shown.

In other forms where the pump bodies are the moving parts the pistons will be the parts fixed to a supporting structure.

Secondly, the driving rod (2) is attached to the cam system and the driving means, and possibly is also restricted by the supporting structure (1) so as to ensure it remains reciprocating substantially in or parallel to the first plane and provides support to prevent swivelling of the cam system.

Thirdly, as shown in FIG. 1, an upper bush (51) for each piston is fixed to or a part of the support structure. The upper bushes guide the reciprocation of the pistons.

If connecting arms are utilised the motion of the cam followers and pistons is also aided by bearings on the connecting arms that bear against the sides of the second slots. FIGS. 4 and 5 show two cavities (54, 55) in the connecting arm (52). Portions of teflon or a like material can be fixed in and protrude from these cavities to help guide to motion of the connecting arms and the reciprocation of the pumps by bearing against the sides of the second slots.

Other forms of attaching bearing materials are possible.

Fourthly, the cam system's reciprocation in the first plane is guided by guide means (3, 4). In FIG. 1, one side of the supporting structure and the guide means on that side are not shown. The guide means (4) on the other side is partially shown and partially obscured by the driving rod and cam system. It is therefore shown by a combination of solid and dashed lines. In FIG. 3 the supporting structure (1) is not shown but the position of the guide means (3) on one side of the cam system is shown by dashed lines. In this preferred form the guide means (3, 4) comprise races in the supporting structure (1).

The cam system includes a central axle (5) that penetrates the cams (30, 31) and runs on bearings (6,7) along guide means (3, 4) on either side of the cam system.

In other forms the type of guide means may vary. The guide means or the bearings may be crowned, flat or of other design or the guide means may consist of rails, tracks or other linear bearings etc. There may be more than two guide means, they may be positioned differently and they may interact with bearings, sledges or wheels on a frame connected to the cam system rather than an axle. The axle may not penetrate the cams but be indirectly connected to the cams.

Use of the central axle (5) in the preferred form serves purposes other than just interacting with the guide means (3, 4). The central axle (5) also connects and supports the cams (30, 31) preventing, with the aid of other features yet to be described, twisting or relative movement between the cams (30, 31) when the cam system is subjected to forces from the driving means and the pumps. If there was relative movement between the cams (30, 31), the control of pump stroke length may be lessened and correspondingly there would be less control of the pumps' volumetric output ratio.

The cams may be permanently fixed in relation to each other. This may be practical when the invention is used as a component in apparatus with one primary purpose. However, in the preferred form, the invention includes an adjustment system so that the gradient of one of the cams (31) is adjustable. In FIGS. 1, 2 and 3 the adjustment is facilitated by rocking the cam (31) about a common axis and regulating the rocking using a adjustment regulating means in the form of a finely threaded adjustment means (12). In the preferred form, the central axle (5) serves as the common axis. In the preferred form the adjustment system thus includes the central axle around which the cam may be rocked and the finely threaded adjustment means (12).

In other forms of the invention there may be more than two cams and more than one cam may be adjustable.

In the preferred form the gradient of one cam (30) is not adjustable and is fixed at full stroke by its interaction with the driving rod (2). The gradient of the other cam (31) is adjustable within a range from full stroke to no stroke by use of the adjustment regulating means.

In other forms of the invention the connection between the driving means and the cam system may be different to that illustrated in FIGS. 1, 2 and 3. For instance, the cam system may be housed by a frame that is in turn attached to the driving means. This or other configurations may allow all or any of the cams to be adjustable.

For the pumps (41, 42) to work to their fullest potential the pistons (43, 44) must begin at a fully depressed position (13), be elevated to a position that is determined by the cam gradients then return to the fully depressed position in the course of one reciprocation of the cam system. Ideally therefore, there should be a zero axis (14) upon which the cam followers (34, 35) align at each end of a complete reciprocation and that when the cam followers (34, 35) occupy this zero axis (14) the pistons (43, 44) will be in the fully depressed position (13). To retain a zero axis (14) that remains occupiable by the cam followers (34, 35) even when the cams (30, 31) are adjusted to different gradients (in an adjustable cam system) and without placing undue strain on the cams, cam followers and pistons and without requiring the cam race means (32, 33) to have overruns more substantial than the overruns (19, 20) in the preferred form, it is necessary for the common axis, namely the central axle (5), to be positioned as close as practically possible to the zero axis (14).

The preferred form of the invention is most efficient and robust when at the beginning and end of each reciprocation of the cam system (i.e. when the pistons or pump bodies are all in the fully depressed position and the cam followers are aligned on the zero axis), the central axle (5) occupies the same plane as is occupied by the cam followers and in which the connecting arms or pistons or pump bodies reciprocate.

FIG. 1 shows the central axle (5) in this plane.

In other forms where the common axis is further from the zero axis suitable modifications will need to be made if a zero axis that is occupiable by both or all of the cam followers is to be retained.

Adjustment regulating means other than finely threaded adjustment means may be used and the adjustment regulating means may provide for continuous or quantitative adjustment. Other forms of the invention using more than two pumps may require the adjustment system to include more than a single continuous or quantitative adjustment regulating means and may use an adjustment regulating means that can regulate the adjustment of all or any of the cams.

In the preferred form adjustment of the cams (30, 31) is secured by locking nuts (15).

Other forms of the invention may use other means to secure the adjustment. For example when quantitative adjustment regulating means are used the adjustment may be secured by aligning holes in two or more extensions from the cams and passing a pin through the aligned holes.

In the preferred form of the invention as shown in FIG. 1, the cams (30, 31) include markings (21). These markings (21) can be used when adjusting cam gradients and correspond to volumetric ratios. These markings are not essential to the invention but may be advantageous when the invention includes an adjustable cam.

In the preferred form the reciprocation of the cam system is substantially parallel to the direction of the forces applied to the cam system by the driving means.

In other forms the forces may be at other angles to the reciprocation though this would result in only the components of the forces that are in the directions of reciprocation being used with other force components being used or having to be absorbed by the cam system, the supporting structures and/or other aspects of the apparatus.

In the preferred form the reciprocation of the cam system is substantially normal to the reciprocation of the pistons (43, 44).

In other forms other angles could be used. In some circumstances other angles could be advantageous as it may allow better interaction between the invention and any apparatus it is used in conjunction with.

The driving means may take various forms though it should be double acting. Typically a double acting hydraulic or air ram will be used. other possible driving means include rotary engines with a crank or camshaft.

The pumps may be of various forms and the pumps used in any particular system may be equivalent or nonequivalent.

In other forms of the invention the regulated reciprocating movements generated by the invention may be translated by translating means into different planes.

Use of the multi-pump controlling means allows fluids from separate sources to each be drawn into separate pumps in regulated volumes and then expelled from the pumps to a common outlet or receptacle, under high or low pressure thus resulting in a multi-component fluid the composition of which is controlled. Typical uses are in mixing paints or resins.

INDUSTRIAL APPLICABILITY

The present invention is used to provide a pump driving and controlling system that can be used to create flows of multiple fluids at high or low pressures. This system could be used as a component of spraying or mixing equipment having the advantage that such equipment could be operated without the use of premixers or proportioners.

What is claimed is:

1. A method of creating a multiple component fluid or spray comprising the steps of adjusting a gradient of at least one cam of a cam system of a multi-pump controlling means to regulate a drawing capacity of a series of pumps attached to the multi-pump controlling means;

operating the multi-pump controlling means to draw fluids from separate sources; and subsequently expelling the fluids to a common outlet or receptacle.

2. A method of creating a multiple component fluid or spray as claimed in claim 2 wherein said plural component fluid or spray is expelled at high pressure.

3. A multi-pump controlling means comprising:

a cam system including at least two cams, said cam system in use being driven by a driving means adapted to reciprocate said cam system in a first plane;

at least two pumps each including a pump body and a piston adapted to mutually reciprocate in a second plane not lying in or parallel to said first plane;

cam followers each corresponding to a cam and to a pump, said cam followers being fixed to reciprocate with the reciprocation of an associated one of the piston and the pump body, said cam followers also being adapted to follow a path determined by said cam follower's respective cam upon reciprocation of the cam system, motion of the cam followers being aided by bearings;

wherein, in use the multi-pump controlling means are adapted so that the reciprocating motion of the cam system drives the pumps by causing relative movement between each cam and its respective cam follower and thus causing relative movement between said cam follower and the respective associated one of the piston and the pump body, and their corresponding one of the pump body and the piston;

and wherein the cams are connected by a connecting means so that there will be no relative movement between any of said cams when subjected to the forces applied to the cam system by the driving means and the pumps;

and wherein said connecting means includes a central axle.

4. A multi-pump controlling means as claimed in claim 3, wherein said bearings are crowned.

5. A multi-pump controlling means comprising:

a cam system including at least two cams, said cam system in use being driven by a driving means adapted to reciprocate said cam system in the first plane, wherein said cam system includes an adjustment system allowing a gradient of at least one of the cams to be adjusted;

at least two pumps each including first and second pump components adapted to reciprocate in relation to each other in a second plane not lying in or parallel to said first plane;

cam followers each corresponding to a cam and to a pump, said cam followers being fixed to reciprocate with the reciprocation of the associated first pump component, said cam followers also being adapted to follow a path determined by said cam follower's respective cam upon reciprocation of the cam system;

wherein, in use the multi-pump controlling means may be adapted so that the reciprocating motion of the cam system drives the pumps by causing relative movement between each cam and its respective cam follower and thus also causing relative movement between said cam follower plus associated first pump component, and their respective second pump component;

and wherein the cams are connected by a connecting means so that there will be no relative movement between any of said cams when subjected to the forces applied to the cam system by the driving means and the pumps;

and wherein said connecting means includes a central axle.

6. A multi-pump controlling means as claimed in claim 5, wherein the motion of the cam system is substantially parallel to the direction of the forces applied to it by the driving means.

7. A multi-pump controlling means as claimed in claim 5, wherein the reciprocation of the first pump component is substantially normal to the motion of the cam system.

8. A multi-pump controlling means as claimed in claim 1 wherein the cams are marked to facilitate adjustment to positions that correspond with required pump volumetric output ratios.

9. A multi-pump controlling means as claimed in claim 5, wherein said multi-pump controlling means also includes connecting arms each corresponding to a cam follower and a pump.

10. A multi-pump controlling means as claimed in claim 5, wherein the motion of the cam followers is aided by bearings.

11. A multi-pump controlling means as claimed in claim 10, wherein said bearings are crowned.

12. A multi-pump controlling means as claimed in claim 1, wherein the adjustment system is controlled by an adjustment regulating means.

13. A multi-pump controlling means as claimed in claim 12, wherein the adjustment regulating means is a finely threaded adjustment means.

14. A multi-pump controlling means as claimed in claim 1, wherein the accuracy and consistency of both said cam system's motion and the cam followers' motion and thus the volumetric output of the pumps may be ensured by:

the driving means and the second pump components being fixed to a supporting structure;

the cam system's movement being guided by a guide means;

the interaction between the driving means and the cam system being by way of a rigid structure adapted to prevent the cam system from swivelling; and the cams being connected by the connecting means.

15. A multi-pump controlling means as claimed in claim 14, wherein the cam system is connected to a structure that bears at least one sets of followers that follow the guide means.

16. A multi-pump controlling means as claimed in claim 14, wherein the first pump components are pistons and the second pump components are pump bodies.

17. A multi-pump controlling means as claimed in claim 14, wherein the accuracy and consistency of the cam followers' and the pistons' motion and thus the volumetric output of the pumps is also ensured by an upper bush for each piston being fixed to or a part of the supporting structure or pumps.

18. A multi-pump controlling means as claimed in claim 14, wherein the guide means is part of the supporting structure and consists of race means tracing the intended pathway of the cam system.

19. A multi-pump controlling means as claimed in claim 18, wherein the cams are aligned on a common axis and adjustment is provided by rocking at least one of the cams about said common axis.

20. A multi-pump controlling means as claimed in claim 19, wherein the central axle serves as the common axis.

21. A multi-pump controlling means as claimed in claim 6, wherein the central axle penetrates the cams as close as practically possible to a zero axis.

22. A multi-pump controlling means as claimed in claim 21, wherein when the cam followers are aligned on the zero axis, the central axle occupies the same plane as is occupied by the cam followers and the zero axis and which the first pump component reciprocates.

23. A multi-pump controlling means as claimed in claim 22, wherein the said central axle serves as a follower to the guide means.

24. A multi-pump controlling means as claimed in claim 23, wherein the central axle's interaction with the guide means is aided by bearings.

25. A multi-pump controlling means as claimed in claim 24, wherein said bearings are crowned.

* * * * *